United States Patent [19]

F'Geppert

[11] 4,395,062

[45] Jul. 26, 1983

[54] COVER HOLD DOWN MECHANISM

[75] Inventor: Erwin F'Geppert, Novi, Mich.

[73] Assignee: The United States of America as represented by the Secretary of the Army, Washington, D.C.

[21] Appl. No.: 193,225

[22] Filed: Oct. 2, 1980

[51] Int. Cl.[3] ..... E05C 5/04

[52] U.S. Cl. ..... 292/64; 24/221 R; 292/212; 292/251; 292/256.75; 411/349

[58] Field of Search ..... 292/57, 58, 63, 64, 292/71, 155, 195, 212, 251, 256.73, 256.75; 411/349, 350; 24/221 R, 221 K

[56] References Cited

U.S. PATENT DOCUMENTS

| | | | |
|---|---|---|---|
| 832,093 | 10/1906 | Stoltzfus | 292/212 X |
| 912,930 | 2/1909 | Alderman | 292/57 |
| 1,327,011 | 1/1920 | Arndt | 292/256.73 X |
| 1,551,311 | 8/1925 | Klein et al. | 292/212 |
| 1,876,237 | 9/1932 | Jackson | 292/256.73 |
| 2,181,278 | 11/1939 | Lantz | 292/212 X |
| 2,334,012 | 11/1943 | Koch et al. | 292/212 |
| 2,873,991 | 2/1959 | Larimore | 292/58 X |
| 3,244,442 | 4/1966 | Arbogast | 292/256.75 X |
| 3,443,783 | 5/1969 | Fisher | 24/221 R |

FOREIGN PATENT DOCUMENTS

| | | | |
|---|---|---|---|
| 2656858 | 6/1978 | Fed. Rep. of Germany | 292/64 |

*Primary Examiner*—Thomas J. Holko

*Attorney, Agent, or Firm*—Peter A. Taucher; John E. McRae; Robert P. Gibson

[57] ABSTRACT

This invention pertains to a screw-nut mechanism for clamping two work pieces together. In one application the mechanism is used to clamp a cover plate over an access opening in a vehicle hull or similar member. The screw-nut mechanism is specially designed for use where one face of the hull or similar fixed work piece is inaccessible for welding or otherwise affixing the nut on the concealed face of the inaccessible work piece. I provide a scre-nut mechanism that avoids the necessity for affixing the nut to the work piece. In my invention the nut is a loose hardware item that can have a thread length proportional to the expected load, thereby avoiding strength problems associated with the formation of threads directly in relatively thin work pieces.

1 Claim, 10 Drawing Figures

COVER HOLD DOWN MECHANISM

The invention described herein may be manufactured, used and licensed by or for the Government for governmental purposes without payment to me of any royalty thereon.

BACKGROUND AND SUMMARY

My invention contemplates an arrangement wherein the nut-screw assembly is constructed so that the nut can be passed through an entrance opening in one of the work members to a position behind the plane of the inaccessible member. The assembly includes a motion-limiting stop element extendable into a cut-out portion of the nut to permit limited arcuate motion of the nut to a position out of registry with the entrance opening. Application of a turning force on the accessible head of the screw imparts limited arcuate motion to the concealed inaccessible nut; thereafter the turning force causes the nut to be drawn axially along the screw into tight engagement against the inaccessible surface of the associated member.

My invention is believed to have several important practical advantages in those situations where it is necessary to employ a nut in a blind location behind a relatively inaccessible surface of a work member. For example, use of my invention avoids the necessity for welding or otherwise affixing the nut on the inaccessible face of the hull wall or other similar work member, thus avoiding the expense associated with welding. As related to the above, my invention permits connections to be made quickly in a single step operation. Also, since the nut is not welded or otherwise affixed to the associated work member the nut can be readily replaced without destroying or dismantling the work members, as necessary for example when the nut or screw threads become stripped or deformed. Since my invention avoids the need for welding it is susceptible to use where welding and associated welding heat are not acceptable, as for example when the installation involves plastics or metals susceptible to destruction by welding heat.

THE DRAWINGS

Figure 6:
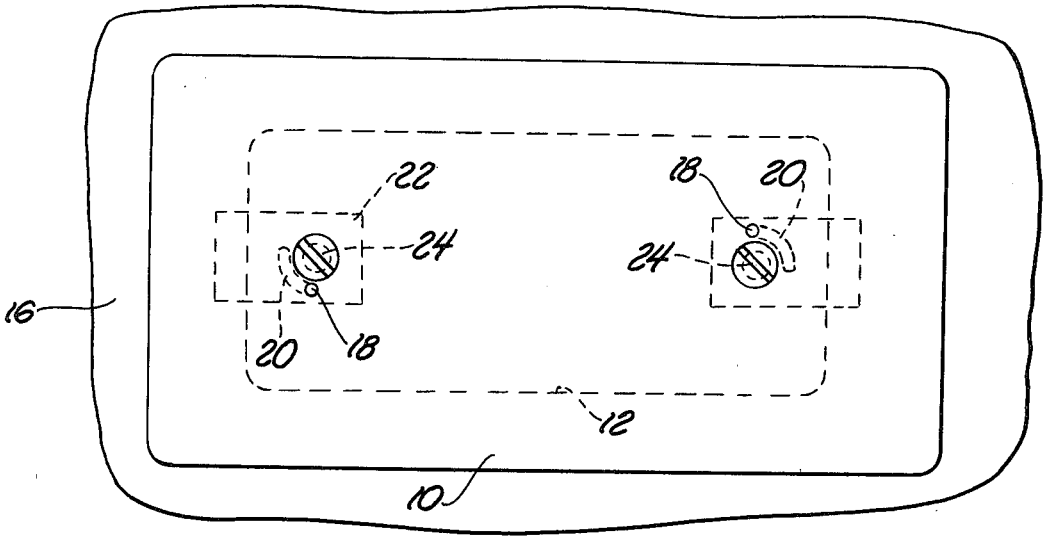
FIG. 6 shows a variation of applicant's invention wherein the mounting mechanism cooperates with the opening closed by the coverplate rather than with a separate opening as in the previously described embodiments of applicant's device. In the FIG. 6 form of my invention two screws and rectangular nuts are used.
Figure 7:
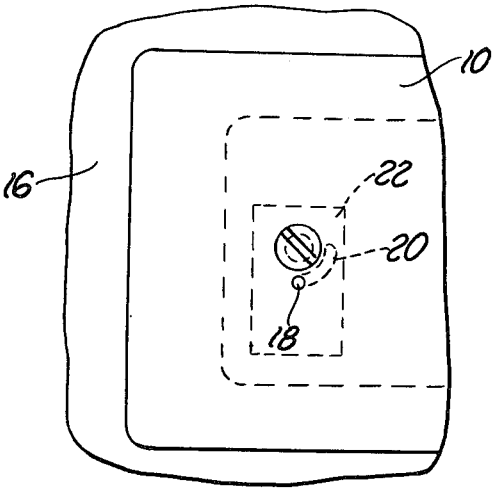

FIG. 7 fragmentarily illustrates one of the FIG. 6 rectangular nuts 22 positioned to allow removal of coverplate 10.

Figure 8:
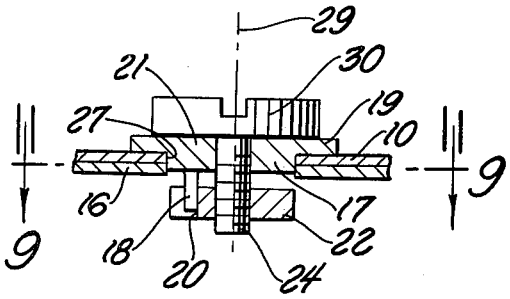

FIG. 8 shows an alternative form of this device wherein a bushing provided with a limiting pin is used.

Figure 9:
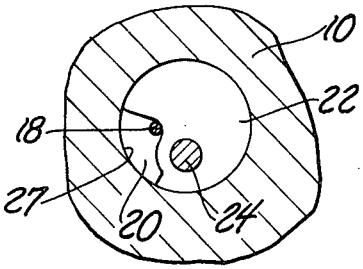

FIG. 9 is a fragmentary sectional view taken on line 9—9 in FIG. 8.

Figure 10:
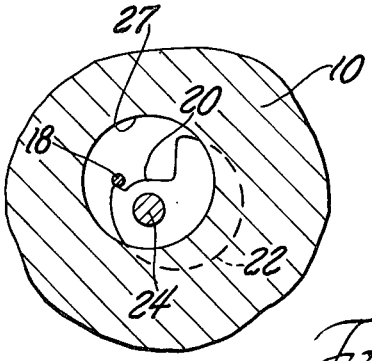

FIG. 10 is a view similar to FIG. 9 but showing nut 22 positioned out of registry with an opening in one member to be joined so that the connecting mechanism cannot be removed, thereby clamping the members together.

Each form of the invention is advantageous in providing a detachable mount-mechanism that does not require a permanently affixed nut for the hold-down screw.

Figure 1:
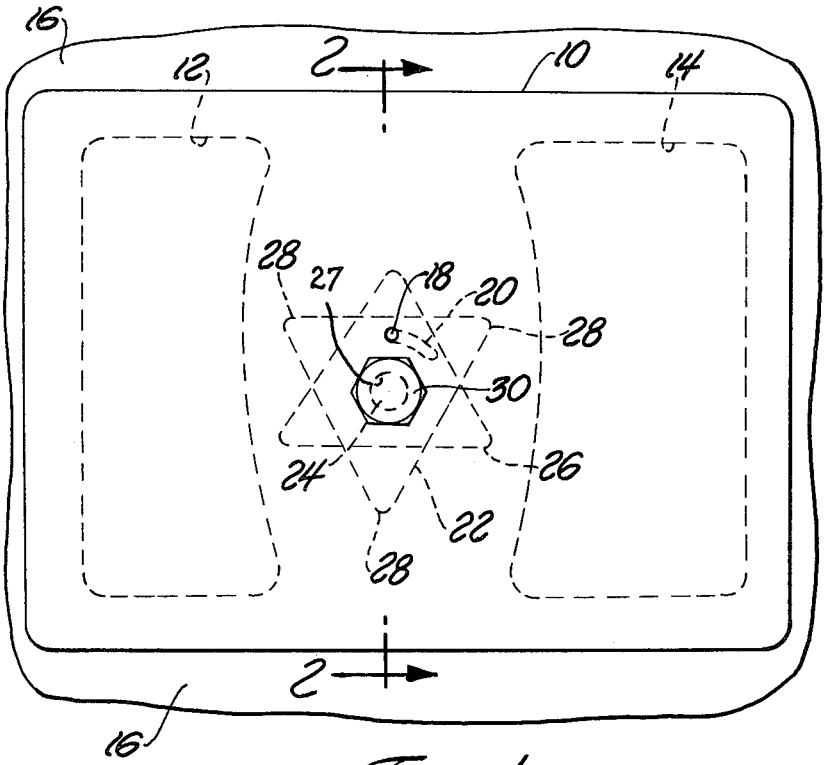
FIG. 1 is a plan view of a coverplate mounting mechanism embodying my invention.

Referring to FIG. 1, there is shown a coverplate 10 arranged to overlie two openings 12 and 14 in wall 16. Wall 16 may, for example be a hull wall in any military vehicle wherein openings are provided for access into the vehicle, either for maintenance of equipment or inspection of the interior of the hull wall. In a typical situation the space to the left of wall 16 (FIG. 2) is inaccessible to the technician; coverplate 10 must be attached to wall 16 from the area to the right of the wall. Wall 16 is provided with an equilateral triangular opening 26 located between the openings 12 and 14 to be covered. The coverplate 10 is preferably slighltly bowed in cross section so that it may undergo slight deformation to make pressure contact with hull wall 16 around its perimeter. This is more clearly seen in FIG. 2.

Figure 2:
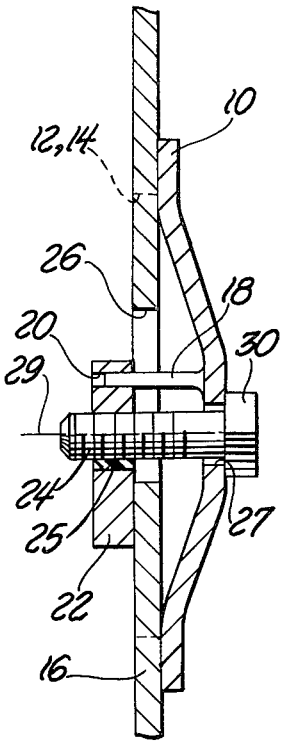
FIG. 2 is a cross-sectional view of the FIG. 1 mounting mechanism taken along line 2—2 of FIG. 1.

Coverplate 10 is manufactured in such a way that its perimeter extends beyond the openings to be covered in hull wall 16. In plan view, as seen in FIG. 1, coverplate 10 is a rectangular sheet of metal or plastic having a relatively small circular opening 27 that is alignable with the center point of the equilateral triangular opening 26 in hull wall 16 along axis 29. Coverplate 10 has welded or otherwise affixed thereto a motion limiting pin 18 offset and parallel to axis 29 of the opening 27 in the coverplate. As seen in FIG. 2 limiting pin 18 extends from coverplate 10 through the opening 26 in hull wall 16 and into an arcuate slot 20 in triangular nut 22. The purpose of limiting pin 18 is to regulate how far triangular nut 22 may rotate clockwise or counter clockwise i.e., the nut can be turned until the apices of the triangular nut are midway between the apices of triangular opening 26 so that the apex areas of the nut are behind wall 16.

Nut 22 has an equilateral triangular profile shape that is slightly smaller than the equilateral triangular opening 26 in hull wall 16. Being slightly smaller than triangular opening 26, nut 22 may be easily inserted and removed once the apices of the triangular nut and opening are aligned. The aforementioned arcuate slot 20 is arranged on nut 22 in such a way as to allow a maximization of the area of engagement between the nut and the inaccessible surface of the member to be joined, in this case the hull wall 16, when the nut is turned in the clockwise direction. Nut 22 is also equipped with a plastic insert 25 used to achieve a semi-lock fit of screw 24 in nut 22.

Referring to FIG. 2, screw 24 is a state of the art screw with a threaded stem of sufficient length so that when inserted through opening 27 in coverplate 16 it will extend into threaded nut 22. The aforementioned screw has a head 30 of sufficient diameter to overlap opening 27 in coverplate 10.

Figure 3:
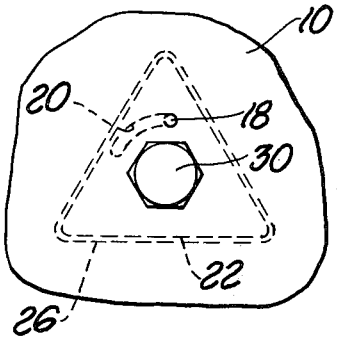
FIG. 3 is a fragmentary illustration of the FIG. 1 coverplate depicting nut 22 positioned to pass through an opening 26 in the member on which the coverplate is to be mounted.
Figure 4:
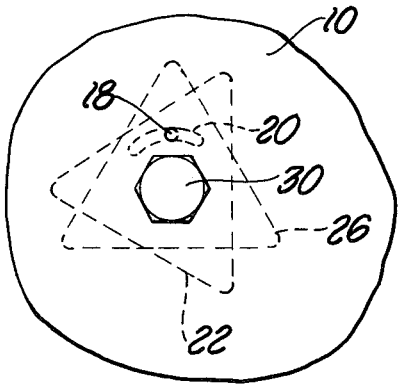
FIG. 4 illustrates fragmentarily the FIG. 1 system with nut 22 positioned out of registry with opening 26 in the member on which the coverplate is to be mounted, such that the nut and screw cooperatively hold the coverplate in its installed position.

As seen in FIGS. 3 and 4, by turning head 30 of screw 24 in the clockwise direction, the nut rotates in the same direction, causing arcuate slot 20 to move along pin 18 until the left end of the slot contacts the pin, as shown in FIG. 1. It should be noted that slot 20 need not be arcuate, only that its endpoints be such that they allow maximization of the area of nut 22 which may engage the inaccessible rear surface of hull 16. In the case of an equilateral triangle, the slot endpoints would preferably be 60° apart. Similarly if nut 22 were a square, then the slot endpoints would preferably be about 45 degrees apart.

Figure 5:
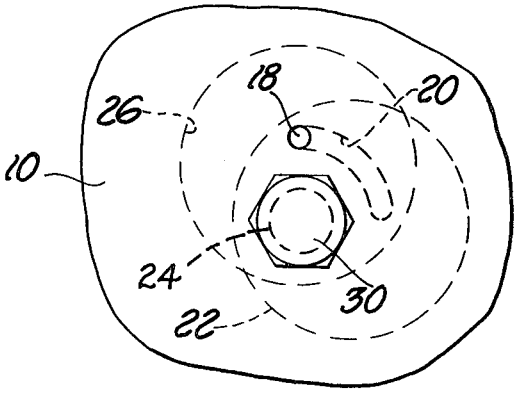
FIG. 5 is a variation of applicant's invention wherein nut 22 has a circular profile to pass through a circular opening in the hull wall or other similar member.

FIG. 5 depicts the arrangement of nut and opening using a circular configuration. Note that in this variation, circular nut 22 is off-centered to threaded screw 24 so that when rotated it engages the inaccessible surface of hull 16 on one side only, thereby clamping the members together. Arcuate slot 20 is preferably arranged in such a way as to maximize the area of engagement with hull 16. The off-centered orientation of the nut relative to the axis of circular opening 26 produces a vary slight tilt of the nut relative to a plane normal to the screw axis; this slight tilt advantageously minimizes thread parallelism effects which would tend to produce a floating condition of the nut and eventual nut loosening in the presence of vibrational forces.

FIGS. 6 and 7 depict an arrangement wherein two nuts 22 are used. Each nut is insertable through the same opening 12 that is to be closed by coverplate 10; in this case there is no need to provide a separate nut-receiver opening 26, as in the systems of FIGS. 1 through 5.

In each of the illustrated systems, FIGS. 1 through 7, the coverplate 10 is installed on hull wall 16 by manipulating head 30 of screw 24 so that each nut 22 is turned to the limit of its motion in the counterclockwise direction; limiting pin 18 is not visible to the technician but he/she is able to sense the rotational orientation of nut 22 by merely rotating screw head 30 to the limit of its counterclockwise motion. The frictional forces between the threaded surfaces on screw 24 and nut 22 will be sufficient to cause the nut to rotate with the screw when a rotational force is applied to head 30. As coverplate 10 is pushed against wall 16, nut 22 should pass through the opening 26 in wall 16 (or opening 12 in FIG. 6 system); in some cases it might be necessary to shift coverplate 10 slightly along hull wall 16. The assembly is constructed so that when coverplate 10 rests against wall 16, nut 22 is necessarily behind the plane of hull wall 16, due to the axial spacing of nut 22 from the head of screw 24. With coverplate 10 held against hull wall 16, a clockwise turning force can be applied to head 30 of screw 24, as by a wrench or screwdriver, whereupon the nut will rotate in a clockwise direction until the left end of slot 20 reaches pin 18; in such an orientation the nut will have extensive areas positioned behind hull wall 16. Final tightening-down force on screw head 30 will draw the nut forwardly against the rear face of hull wall 16. During this operation, element 18 acts as a keying device to prevent rotation of the nut, whereby the nut is caused to travel along the screw into tightened engagement with wall 16. The slight bow in coverplate 10, as shown in FIG. 2, will produce a slight axial tension force tending to keep the cover tight against hull wall 16. Plastic insert 25 prevents the nut from loosening when the assembly is in normal use by forming a semi-lock condition between the nut and screw. Removal of the coverplate is accomplished merely by applying a counterclockwise wrench force on head 30. Note that in each case, installation or removal, only a single wrench action is required to accomplish the particular operation.

FIGS. 8 through 10 illustrate an embodiment of the invention that employs loose hardware screw-nut components for clamping two work members 10 and 16 together; the members are provided with aligned circular holes 27 for receiving the screw-nut connector components. The screw 24 and nut 22 are arranged essentially the same as in FIG. 5, except that a centering element is also necessary to position the connecting mechanism correctly in the aligned openings 27. The centering element is a flanged disc 21 insertable in openings 27; the disc has a motion-limiting projection 18 extendable into a cutout 20 in nut 22.

To install and tighten the connector mechanism the assembly comprised of screw 24, nut 22 and disc 21 is manually moved in a downward direction so that nut 22 and the small diameter portion of disc 21 pass through aligned circular openings 27 in members 10 and 16. When the assembly is in the position shown in FIGS. 8 and 9 a clockwise turning force is applied to head 30 of the screw; during this time it may be necessary for the technician to grip flange 19 to prevent undesired rotaion of disc 21. When screw 24 has been turned about ninety degrees nut 22 will be in the FIG. 10 position wherein the left edge of cutout 20 is engaged with pin 18, thus preventing further rotation of the nut in the clockwise direction. Continued clockwise turning force on the head of screw 24 will cause nut 22 to advance along the shank portion of the screw into tight engagement with the associated face of member 16. Removal of the scew 24, nut 22, disc 21 assembly can be accompanied by turning the screw counter clockwise and lifting the assembly upwardly through openings 27. The invention would find most application in installations where the space beneath member 16 is enclosed or otherwise inaccessible, e.g. where member 16 is a floor plate, one wall of a box, etc.

I wish it to be understood that I do not desire to be limited to the exact details of construction shown and described for obvious modifications will occur to a person skilled in the art.

I claim:

1. In combination, first and second members (16 and 10) designed to be secured together, said first member having an accessible face and an inaccessible face, said first member having a triangular opening (26) extending between the two faces, said second member having an opening (27) extending therethrough; a connector device comprising a scew (24) having an enlarged accessible head (30) and a threaded shank extending through the opening in the second member toward the first member, a nut (22) threaded on the shank, said nut having a triangular perimetrical configuration that is slightly smaller dimension than said triangular opening whereby the nut can be extended through the triangular opening without disconnecting the nut from the screw, said nut having a cutaway area (20) whose length measured about the axis of the screw is approximately sixty degrees, and a motion-limiting member (18) extending from the second member into the cutaway area of the nut so that after the nut has been passed through the triangular opening in the first member the screw can be turned to initially produce limited rotary movement of the nut approximately sixty degrees into a position of axial overlapment with the inaccessible surface of said first member, said screw being further turnable to cause the nut to move axially along the screw into tightened engagement with the inaccessible face of said first member; said motion-limiting member acting to prevent rotation of the nut while said nut is undergoing said last-mentioned axial motion toward the inaccessible face of said first member.

* * * * *